US012297625B2

(12) United States Patent
Shimizu et al.

(10) Patent No.: US 12,297,625 B2
(45) Date of Patent: May 13, 2025

(54) MANIPULATION GUIDE DEVICE

(71) Applicant: KOMATSU LTD., Tokyo (JP)

(72) Inventors: Minoru Shimizu, Tokyo (JP); Nobuyoshi Yamanaka, Tokyo (JP); Masaki Daimon, Tokyo (JP); Hiroyuki Aratame, Tokyo (JP)

(73) Assignee: KOMATSU LTD., Tokyo (JP)

( * ) Notice: Subject to any disclaimer, the term of this patent is extended or adjusted under 35 U.S.C. 154(b) by 266 days.

(21) Appl. No.: 17/799,061

(22) PCT Filed: Mar. 4, 2021

(86) PCT No.: PCT/JP2021/008395
§ 371 (c)(1),
(2) Date: Aug. 11, 2022

(87) PCT Pub. No.: WO2021/182285
PCT Pub. Date: Sep. 16, 2021

(65) Prior Publication Data

US 2023/0068838 A1 Mar. 2, 2023

(30) Foreign Application Priority Data

Mar. 11, 2020 (JP) ..... 2020-041832

(51) Int. Cl.
*E02F 9/26* (2006.01)

(52) U.S. Cl.
CPC ..... *E02F 9/264* (2013.01)

(58) Field of Classification Search
CPC ..... G06T 2200/24; G05B 2219/2641; G07C 5/0808; G06F 3/0484
See application file for complete search history.

(56) References Cited

U.S. PATENT DOCUMENTS

| | | | | |
|---|---|---|---|---|
| 10,782,672 | B2 * | 9/2020 | Blank | G05B 19/4083 |
| 2013/0158784 | A1 | 6/2013 | Fukano et al. | |
| 2016/0104391 | A1 | 4/2016 | Wieland et al. | |
| 2016/0193920 | A1 | 7/2016 | Tsubone et al. | |
| 2016/0247332 | A1 | 8/2016 | Egawa | |
| 2017/0255895 | A1 | 9/2017 | Kozumi et al. | |

(Continued)

FOREIGN PATENT DOCUMENTS

| | | | |
|---|---|---|---|
| CN | 103080436 | A | 5/2013 |
| CN | 104884713 | A | 9/2015 |

(Continued)

*Primary Examiner* — Khoi H Tran
*Assistant Examiner* — Dairon Estevez
(74) *Attorney, Agent, or Firm* — Faegre Drinker Biddle & Reath LLP

(57) ABSTRACT

An operator is allowed to easily recognize a difference between a manipulation actually performed when performing a work and a manipulation serving a model for the work. A manipulation guide device for a work machine includes a manipulation device, a storage unit, and a display unit. The manipulation device is manipulated by an operator of the work machine to operate the work machine. The storage unit stores model data serving as a model when the manipulation device is manipulated. The display unit displays a change over time in a result of comparison between actual manipulation data about an actual manipulation of the manipulation device by the operator and model data in a time period during an operation of the work machine.

11 Claims, 5 Drawing Sheets

(56) References Cited

U.S. PATENT DOCUMENTS

| | | | | |
|---|---|---|---|---|
| 2017/0274891 | A1 | 9/2017 | Hita et al. | |
| 2018/0027179 | A1 | 1/2018 | Matsuzaki et al. | |
| 2018/0135273 | A1 | 5/2018 | Tsuji | |
| 2018/0218304 | A1* | 8/2018 | Shike | G06Q 10/0631 |
| 2018/0283476 | A1 | 10/2018 | Kojima et al. | |
| 2019/0048560 | A1* | 2/2019 | Misaki | E02F 9/261 |
| 2019/0249399 | A1 | 8/2019 | Shiina et al. | |
| 2019/0370725 | A1* | 12/2019 | Ha | E02F 9/205 |
| 2020/0074380 | A1* | 3/2020 | Mori | G06Q 10/0633 |
| 2020/0325653 | A1* | 10/2020 | Hageman | E02F 9/265 |
| 2021/0148090 | A1 | 5/2021 | Hashimoto | |
| 2022/0018098 | A1* | 1/2022 | Nakagi | G02B 27/017 |
| 2022/0120056 | A1* | 4/2022 | Andersson | G05D 1/223 |

FOREIGN PATENT DOCUMENTS

| | | | | | |
|---|---|---|---|---|---|
| CN | 106605028 | A | | 4/2017 | |
| CN | 107627957 | A | | 1/2018 | |
| CN | 110536989 | A | | 12/2019 | |
| JP | 2015040422 | A | * | 3/2015 | |
| JP | 2016-156193 | A | | 9/2016 | |
| JP | 2017-220171 | A | | 12/2017 | |
| JP | 2018-169675 | A | | 11/2018 | |
| JP | 2018-172092 | A | | 11/2018 | |
| JP | 2019108721 | A | * | 7/2019 | |
| WO | WO-2010079691 | A1 | * | 7/2010 | B66C 13/18 |
| WO | WO-2016/125915 | A1 | | 8/2016 | |
| WO | WO-2019031509 | A1 | * | 2/2019 | E02F 3/435 |

* cited by examiner

MANIPULATION GUIDE DEVICE

TECHNICAL FIELD

The present disclosure relates to a manipulation guide device.

BACKGROUND ART

According to the disclosure regarding a manipulation guide device in Japanese Patent Laying-Open No. 2018-169675 (PTL 1), when the comparison between the manipulation amount of a work machine manipulated by an operator and the stored standard manipulation amount shows a deviation in manipulation amount equal to or greater than a prescribed threshold value, a manipulation guide image is displayed on a display.

CITATION LIST

Patent Literature

PTL 1: Japanese Patent Laying-Open No. 2018-169675

SUMMARY OF INVENTION

Technical Problem

When the amount of the operator's manipulation deviates from the standard manipulation amount by a prescribed value or more, the manipulation guide image disclosed in the above-mentioned literature shows a manipulation for eliminating the deviation. When the operator performs an incorrect manipulation, the operator can perform a correct manipulation by looking at the manipulation guide image, but the flow of a series of manipulations preferable for performing a certain work cannot be recognized by the operator.

The present disclosure proposes a manipulation guide device that allows an operator to easily recognize a difference between a manipulation actually performed when performing a work and a manipulation serving as a model for the work.

Solution to Problem

According to the present disclosure, a manipulation guide device for a work machine is provided. The manipulation guide device includes a manipulation device, a storage unit, and a display unit. The manipulation device is manipulated by an operator of the work machine to operate the work machine. The storage unit stores model data serving as a model when the manipulation device is manipulated. The display unit displays a change over time in a result of comparison between actual manipulation data about an actual manipulation of the manipulation device by the operator and the model data in a time period during an operation of the work machine.

Advantageous Effects of Invention

The manipulation guide device of the present disclosure allows the operator to easily recognize a difference between the manipulation actually performed when performing the work and the manipulation serving as a model for the work.

DESCRIPTION OF EMBODIMENTS

Hereinafter, embodiments will be described with reference to the accompanying drawings. In the following description, identical components are identically denoted. Their names and functions are also identical. Thus, the detailed description thereof will not be repeated.

<Overall Configuration>

Figure 1:
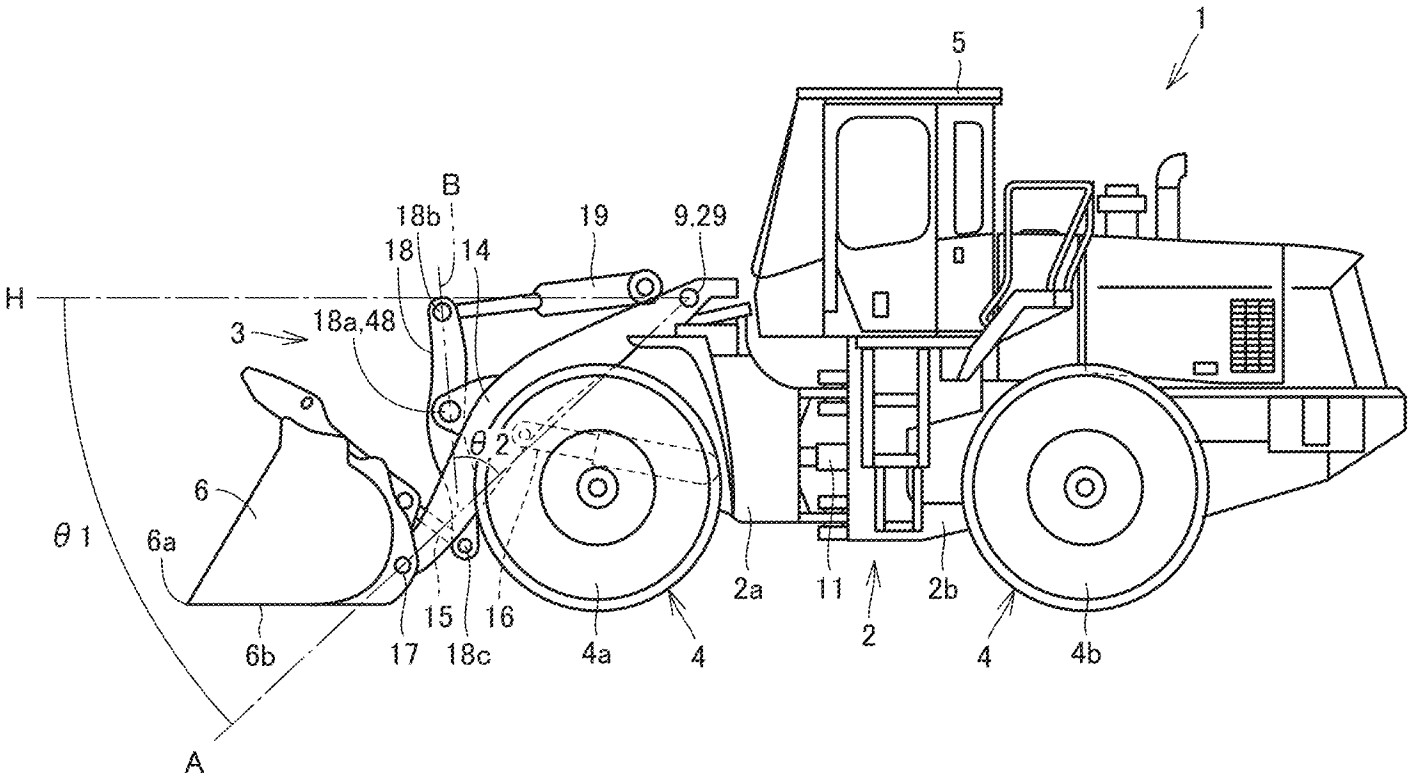
FIG. 1 is a side view of a wheel loader as an example of a work machine according to an embodiment.

In an embodiment, a wheel loader 1 will be described as one example of a work machine. FIG. 1 is a side view of wheel loader 1 as an example of the work machine according to the embodiment.

As shown in FIG. 1, wheel loader 1 includes a vehicular body frame 2, a work implement 3, a traveling unit 4, and a cab 5. Vehicular body frame 2, cab 5 and the like constitute the vehicular body of wheel loader 1. Work implement 3 and traveling unit 4 are attached to the vehicular body of wheel loader 1.

Traveling unit 4 serves to cause the vehicular body of wheel loader 1 to travel, and includes running wheels 4*a* and 4*b*. Wheel loader 1 is movable as running wheels 4*a* and 4*b* are rotationally driven, and also, can perform a desired work using work implement 3.

Vehicular body frame 2 includes a front frame 2*a* and a rear frame 2*b*. Front frame 2*a* and rear frame 2*b* are attached to be capable of mutually swinging rightward and leftward. A pair of steering cylinders 11 is attached across front frame 2*a* and rear frame 2*b*. Steering cylinder 11 serves as a hydraulic cylinder. Steering cylinder 11 is extended and retracted by hydraulic oil received from a steering pump 12 (see FIG. 2) to change the traveling direction of wheel loader 1 in a rightward direction and a leftward direction.

In the present specification, the direction in which wheel loader 1 travels straightforward is referred to as a front-rear direction of wheel loader 1. In the front-rear direction of wheel loader 1, the side where work implement 3 is located with respect to vehicular body frame 2 is referred to as a forward direction, and the side opposite to the forward direction is referred to as a rearward direction. The left-right direction of wheel loader 1 is orthogonal to the front-rear direction in a plan view. The right side and the left side in the left-right direction in facing forward are defined as a right direction and a left direction, respectively. A top-bottom direction of wheel loader 1 is orthogonal to a plane defined by the front-rear direction and the left-right direction. In the top-bottom direction, the ground side is defined as a lower side and the sky side is defined as an upper side.

Work implement 3 and a pair of running wheels (front wheels) 4*a* are attached to front frame 2*a*. Work implement 3 is disposed on the front side of the vehicular body. Work implement 3 is driven by hydraulic oil from a work implement pump 13 (see FIG. 2). Work implement pump 13 is a hydraulic pump that is driven by an engine 20 to discharge hydraulic oil for operating work implement 3. Work implement 3 includes a boom 14 and a bucket 6 that serves as a work tool. Bucket 6 is disposed at the distal end of work implement 3. Bucket 6 is an example of an attachment detachably attached to a distal end of boom 14. Depending on the type of work, the attachment is replaced by a grapple, a fork, a plow, or the like.

Boom 14 has a proximal end portion rotatably attached to front frame 2*a* by a boom pin 9. Bucket 6 is rotatably attached to boom 14 by a bucket pin 17 located at the distal end of boom 14.

Front frame 2*a* and boom 14 are coupled by a pair of boom cylinders 16. Boom cylinder 16 is a hydraulic cylinder. Boom cylinder 16 has a proximal end attached to front frame 2*a*. Boom cylinder 16 has a distal end attached to boom 14. Boom 14 moves up and down when boom cylinder 16 is extended and retracted by hydraulic oil received from work implement pump 13 (see FIG. 2). Boom cylinder 16 rotationally drives boom 14 to be raised and lowered about boom pin 9.

Work implement 3 further includes a bell crank 18, a bucket cylinder 19, and a link 15. By a support pin 18*a* located substantially in the center of boom 14, bell crank 18 is supported on boom 14 so as to be rotatable. Bucket cylinder 19 couples bell crank 18 to front frame 2*a*. Link 15 is coupled to a coupling pin 18*c* provided at a distal end portion of bell crank 18. Link 15 couples bell crank 18 and bucket 6.

Bucket cylinder 19 serves a hydraulic cylinder and also as a work tool cylinder. Bucket cylinder 19 has a proximal end attached to front frame 2*a*. Bucket cylinder 19 has a distal end attached to a coupling pin 18*b* provided at a proximal end portion of bell crank 18. When bucket cylinder 19 is extended and retracted by hydraulic oil from work implement pump 13 (see FIG. 2), bucket 6 pivots up and down. Bucket cylinder 19 drives bucket 6 to rotate about bucket pin 17.

Cab 5 and a pair of running wheels (rear wheels) 4*b* are attached to rear frame 2*b*. Cab 5 is disposed behind boom 14. Cab 5 is mounted on vehicular body frame 2. Inside cab 5, a seat on which an operator of wheel loader 1 sits, a manipulation device 8 described below, and the like are disposed.

<System Configuration>

Figure 2:
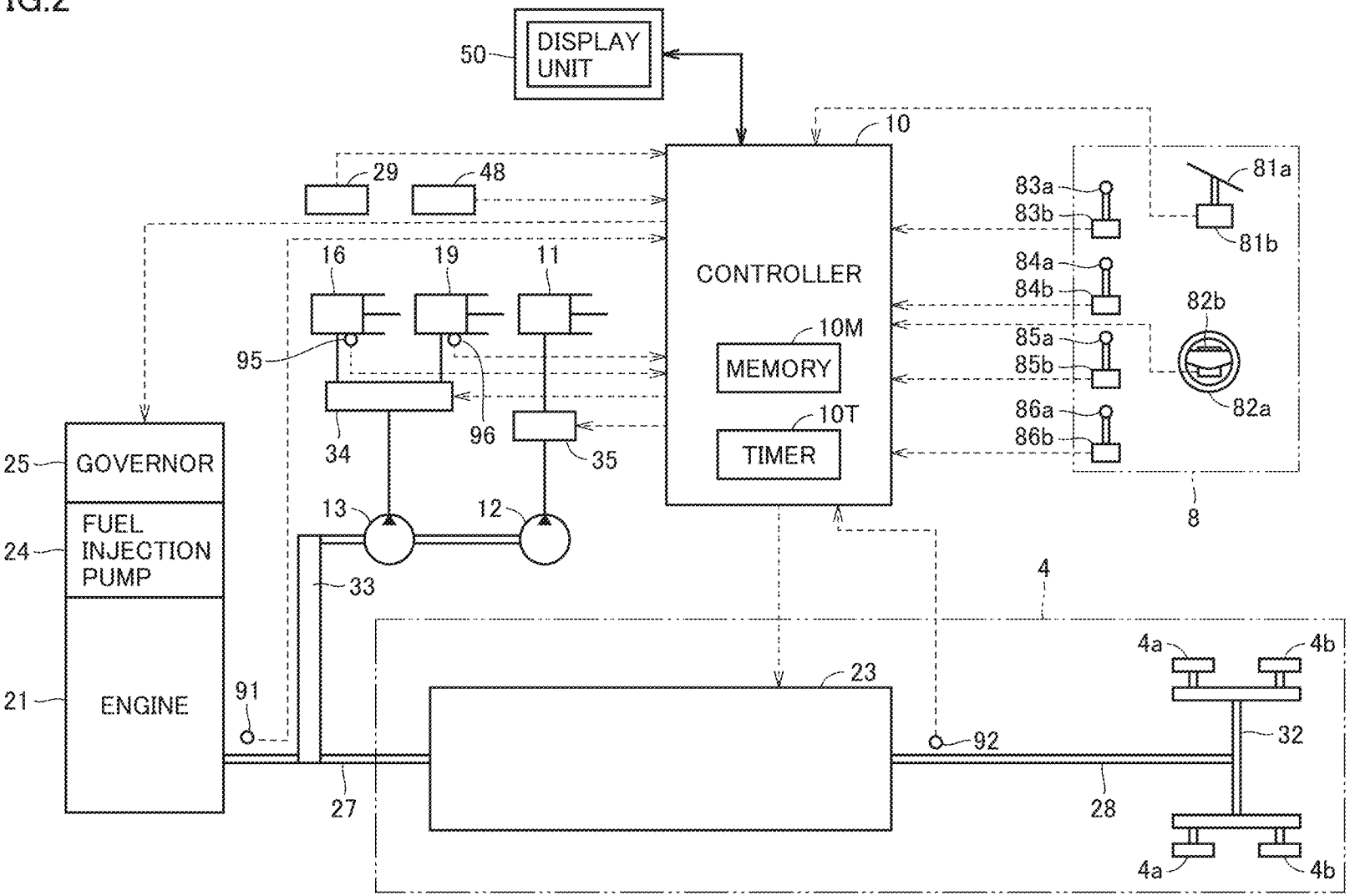
FIG. 2 is a schematic block diagram showing a configuration of the wheel loader according to the embodiment.

FIG. 2 is a schematic block diagram showing a configuration of wheel loader 1 according to the embodiment. As shown in FIG. 2, wheel loader 1 includes engine 21 as a driving source, traveling unit 4, work implement pump 13, steering pump 12, manipulation device 8, a controller 10, a display unit 50, and the like.

Engine 21 is a diesel engine, for example. As the driving source, engine 21 may be replaced with a motor driven by a power storage unit, or the engine and the motor both may be used. Engine 21 includes a fuel injection pump 24. Fuel injection pump 24 is provided with an electronic governor 25. The output of engine 21 is controlled by adjusting the amount of fuel injected into the cylinder. This adjustment is performed by controlling electronic governor 25 by controller 10.

The engine rotation speed is sensed by an engine rotation speed sensor 91. Engine rotation speed sensor 91 outputs a detection signal which is then input to controller 10.

Traveling unit 4 serves to receive driving force from engine 21 to cause wheel loader 1 to travel. Traveling unit 4 includes a power transmission device 23, front wheels 4*a* and rear wheels 4*b* described above, and the like.

Power transmission device 23 is to transmit the driving force from engine 21 to front wheels 4*a* and rear wheels 4*b*, and serves as a transmission, for example. In wheel loader 1, both front wheels 4*a* attached to front frame 2*a* and rear wheels 4*b* attached to rear frame 2*b* constitute driving wheels that receive driving force to cause wheel loader 1 to travel. Power transmission device 23 changes the speed of rotation of an input shaft 27 and outputs the resultant rotation to an output shaft 28.

Output shaft 28 is provided with an output rotation speed sensor 92. Output rotation speed sensor 92 detects the rotation speed of output shaft 28. Output rotation speed sensor 92 outputs a detection signal which is then input to controller 10. Controller 10 calculates vehicular speed based on the detection signal from output rotation speed sensor 92.

Power transmission device 23 outputs driving force which is then transmitted to wheels 4*a* and 4*b* via a shaft 32 and the like. Thus, wheel loader 1 travels. Part of the driving force from engine 21 is transmitted to traveling unit 4, so that wheel loader 1 travels.

Part of the driving force of engine 21 is transmitted to work implement pump 13 and steering pump 12 via a power extraction unit 33. Power extraction unit 33 serves to distribute the output from engine 21 to power transmission device 23 and a cylinder driving unit that is formed of work implement pump 13 and steering pump 12.

Work implement pump 13 and steering pump 12 each are a hydraulic pump driven by driving force output from engine 21. Work implement pump 13 pumps out hydraulic oil which is then supplied to boom cylinder 16 and bucket cylinder 19 via a work implement control valve 34. Steering pump 12 pumps out hydraulic oil which is then supplied to steering cylinder 11 via a steering control valve 35. Work implement 3 is driven by part of the driving force output from engine 21.

A first hydraulic pressure detector 95 is attached to boom cylinder 16. First hydraulic pressure detector 95 detects pressure of hydraulic oil inside an oil chamber of boom cylinder 16. First hydraulic pressure detector 95 outputs a detection signal which is then input to controller 10.

A second hydraulic pressure detector 96 is attached to bucket cylinder 19. Second hydraulic pressure detector 96 detects pressure of hydraulic oil inside an oil chamber of bucket cylinder 19. Second hydraulic pressure detector 96 outputs a detection signal which is then input to controller 10.

A first angle detector 29 is, for example, a potentiometer attached to boom pin 9. First angle detector 29 detects a boom angle representing an angle by which boom 14 is lifted up (or tilted) with respect to the vehicular body. First angle detector 29 outputs a detection signal representing the boom angle to controller 10.

Specifically, as shown in FIG. 1, a boom reference line A is a straight line passing through the center of boom pin 9 and the center of bucket pin 17. A boom angle θ1 is an angle formed by a horizontal line H extending forward from the center of boom pin 9 and boom reference line A. When boom reference line A is horizontal, a boom angle θ1=0°. When boom reference line A is above horizontal line H, boom angle θ1 is positive. When boom reference line A is below horizontal line H, boom angle θ1 is negative.

First angle detector 29 may be a stroke sensor disposed on boom cylinder 16.

A second angle detector 48 is, for example, a potentiometer attached to support pin 18*a*. Second angle detector 48 detects the bell crank angle representing an angle of bell crank 18 with respect to boom 14. Second angle detector 48 outputs a detection signal representing the bell crank angle to controller 10.

Specifically, as shown in FIG. 1, a bell crank reference line B is a straight line passing through the center of support pin 18*a* and the center of coupling pin 18*b*. A bell crank angle θ2 is an angle formed by boom reference line A and bell crank reference line B. When a back surface 6*b* of bucket 6 extends horizontally on the ground while bucket 6 is in contact with the ground, bell crank angle θ2=0°. When bucket 6 is moved in a direction for excavation (or upward), bell crank angle θ2 is positive. When bucket 6 is moved in a direction for dumping (or downward), bell crank angle θ2 is negative.

Second angle detector 48 may detect the angle of bucket 6 (a bucket angle) with respect to boom 14. The bucket angle is an angle formed by: a straight line passing through the center of bucket pin 17 and a blade edge 6*a* of bucket 6; and boom reference line A. Second angle detector 48 may be a potentiometer or a proximity switch attached to bucket pin 17. Alternatively, second angle detector 48 may be a stroke sensor disposed on bucket cylinder 19.

Manipulation device 8 is manipulated by an operator. Manipulation device 8 includes a plurality of types of manipulation members that are manipulated by the operator to operate wheel loader 1. Specifically, manipulation device 8 includes an accelerator manipulation member 81*a*, a steering manipulation member 82*a*, a boom manipulation member 83*a*, a bucket manipulation member 84*a*, a gear-shifting manipulation member 85*a*, and an FR manipulation member 86*a*.

Accelerator manipulation member 81*a* is manipulated to set a target rotation speed of engine 21. Accelerator manipulation member 81*a* is an accelerator pedal, for example. When the amount of manipulation of accelerator manipulation member 81*a* (for an accelerator pedal, the pressing amount, which will be hereinafter also referred to as an accelerator opening degree) is increased, the vehicular body is accelerated. When the amount of manipulation of accelerator manipulation member 81*a* is decreased, the vehicular body is decelerated. Accelerator manipulation member 81*a* corresponds to a traveling-motion manipulation member in the embodiment that is manipulated to cause wheel loader 1 to travel. An accelerator manipulation detection unit 81*b* detects the amount of manipulation of accelerator manipulation member 81*a*. Accelerator manipulation detection unit 81*b* outputs a detection signal to controller 10. Controller 10 controls the output from engine 21 based on the detection signal from accelerator manipulation detection unit 81*b*.

Steering manipulation member 82*a* is manipulated to control the direction in which the vehicle moves. Steering manipulation member 82*a* is a steering handle, for example. Steering manipulation detection unit 82*b* detects the position of steering manipulation member 82*a* and outputs the detection signal to controller 10. Controller 10 controls steering control valve 35 based on the detection signal output from steering manipulation detection unit 82*b*. Steering cylinder 11 extends and retracts to change the direction in which the vehicle travels.

Boom manipulation member 83*a* is manipulated to operate boom 14. Boom manipulation member 83*a* is a control lever, for example. Boom manipulation detection unit 83*b* detects the position of boom manipulation member 83*a*. Boom manipulation detection unit 83*b* outputs a detection signal to controller 10. Controller 10 controls work implement control valve 34 based on the detection signal from boom manipulation detection unit 83*b*. Boom cylinder 16 extends and retracts to operate boom 14.

Bucket manipulation member 84*a* is manipulated to operate bucket 6. Bucket manipulation member 84*a* is a control lever, for example. Bucket manipulation detection unit 84*b* detects the position of bucket manipulation member 84*a*. Bucket manipulation detection unit 84*b* outputs a detection signal to controller 10. Controller 10 controls work implement control valve 34 based on the detection signal from bucket manipulation detection unit 84*b*. Bucket cylinder 19 extends and retracts to operate bucket 6.

Gear-shifting manipulation member 85*a* is manipulated to set gear-shifting by power transmission device 23. Gear-shifting manipulation member 85*a* is a shift lever, for example. Gear-shifting manipulation detection unit 85*b* detects the position of gear-shifting manipulation member 85*a*. Gear-shifting manipulation detection unit 85*b* outputs a detection signal to controller 10. Controller 10 controls power transmission device 23 based on the detection signal from gear-shifting manipulation detection unit 85*b*.

FR manipulation member 86*a* is manipulated to switch the traveling direction of the vehicle between forward and rearward. FR manipulation member 86*a* is switched to a position for forward travel, a neutral position, or a position for rearward travel. FR manipulation detection unit 86*b* detects the position of FR manipulation member 86*a*. FR manipulation detection unit 86*b* outputs a detection signal to controller 10. Controller 10 controls power transmission device 23 based on the detection signal from FR manipulation detection unit 86*b* to switch the state of the vehicle among a forward traveling state, a rearward traveling state, and a neutral state.

Display unit 50 receives a command signal from controller 10 and displays various types of information. Various types of information displayed on display unit 50 may for example be: information about a work performed by wheel loader 1; vehicular body information such as a remaining amount of fuel, a temperature of coolant, and a temperature of hydraulic oil; surrounding images obtained by imaging the surroundings of wheel loader 1; and the like. Display unit 50 may be a touch panel. In this case, a signal generated when the operator touches a part of display unit 50 is output from display unit 50 to controller 10.

Controller 10 is generally implemented by reading various programs by a central processing unit (CPU). Controller 10 includes a memory 10M and a timer 10T. Memory 10M functions as a work memory and stores various types of programs for implementing the function of the wheel loader. Controller 10 reads the current time from timer 10T. Controller 10 calculates the elapsed time from the start of the excavation work, for example, when wheel loader 1 performs the excavation work.

Controller 10 sends an engine command signal to electronic governor 25 so that a target rotation speed corresponding to the amount of manipulation of accelerator manipulation member 81*a* is obtained. Based on the amount of fuel supplied to engine 21 that varies in response to the control by electronic governor 25, controller 10 can calculate fuel consumption per unit running time of engine 21, fuel consumption per unit traveling distance of wheel loader 1, and fuel consumption per unit load weight in bucket 6.

Controller 10 calculates a vehicular speed of wheel loader 1 based on the detection signal of output rotation speed sensor 92. From memory 10M, controller 10 reads a map defining the relation between the vehicular speed and the traction force of wheel loader 1, and then calculates traction force based on the map.

Controller 10 receives a detection signal of the engine rotation speed from engine rotation speed sensor 91. From memory 10M, controller 10 reads a map defining the relation between the engine rotation speed and the engine torque, and then, calculates engine torque based on the map.

The traction force and the engine torque may be calculated in a different way from reference to a map. For example, the traction force and the engine torque may be calculated by referring to a table, or calculation using a mathematical expression, or the like.

<Excavation Work>

Figure 3:
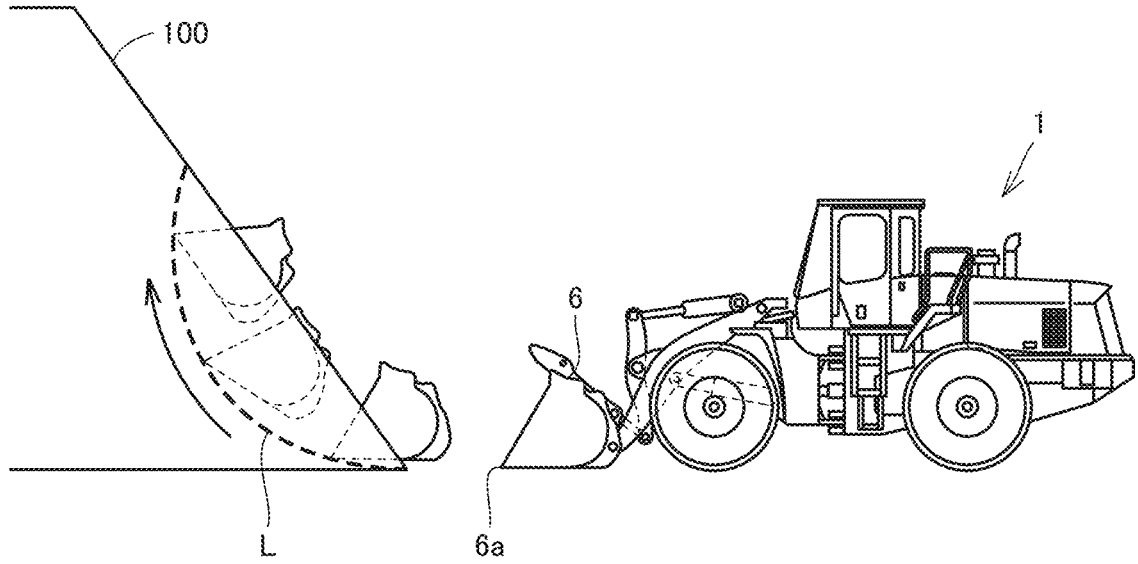
FIG. 3 is a diagram for illustrating an excavation work by the wheel loader according to the embodiment.

Wheel loader 1 in the present embodiment performs an excavation work for scooping an excavation target such as soil and sand. FIG. 3 illustrates an excavation work performed by wheel loader 1 according to the embodiment.

As shown in FIG. 3, wheel loader 1 causes blade edge 6*a* of bucket 6 to bite into an excavation target 100, and subsequently raises bucket 6 along a bucket trajectory L as indicated by a curved arrow in FIG. 3. Thus, an excavation work for scooping excavation target 100 into bucket 6 is performed.

Wheel loader 1 in the present embodiment performs an excavating operation for causing bucket 6 to scoop excavation target 100, and a loading operation for loading a load (excavation target 100) in bucket 6 onto a carrier such as a dump truck.

More specifically, wheel loader 1 repeatedly performs a plurality of work steps as described below in a sequential manner to excavate excavation target 100 and load excavation target 100 onto a carrier such as a dump truck.

A first step is an unloaded forward traveling step of causing unloaded wheel loader 1 to move forward toward excavation target 100. A second step is an excavating (plowing) step of causing wheel loader 1 to move forward until blade edge 6*a* of bucket 6 bites into excavation target 100. A third step is an excavating (scooping) step of manipulating boom cylinder 16 to raise bucket 6 and also manipulating bucket cylinder 19 to tilt bucket 6 back. A fourth step is a loaded rearward traveling step of causing wheel loader 1 to move rearward after excavation target 100 is scooped into bucket 6.

A fifth step is a loaded forward traveling step of causing wheel loader 1 to move forward to approach the dump truck while keeping bucket 6 raised or while raising bucket 6. A sixth step is a soil ejecting step of dumping bucket 6 at a prescribed position to load excavation target 100 onto a loading platform of the dump truck. A seventh step is a rearward traveling and boom lowering step of lowering boom 14 while causing wheel loader 1 to move rearward to return bucket 6 to an excavating position. The above steps are typical work steps constituting one cycle of an excavating and loading work.

For example, based on a combination of the determination conditions about a manipulation by an operator to move wheel loader 1 forward and rearward, a manipulation by an operator for work implement 3, and the current hydraulic pressure of the cylinder of work implement 3, it can be determined whether wheel loader 1 is currently performing an excavating step and thus work implement 3 is currently performing an excavation work, or wheel loader 1 is currently not performing an excavating step and thus work implement 3 is currently not performing an excavation work.

<Productivity of Excavation Work>

Figure 4:
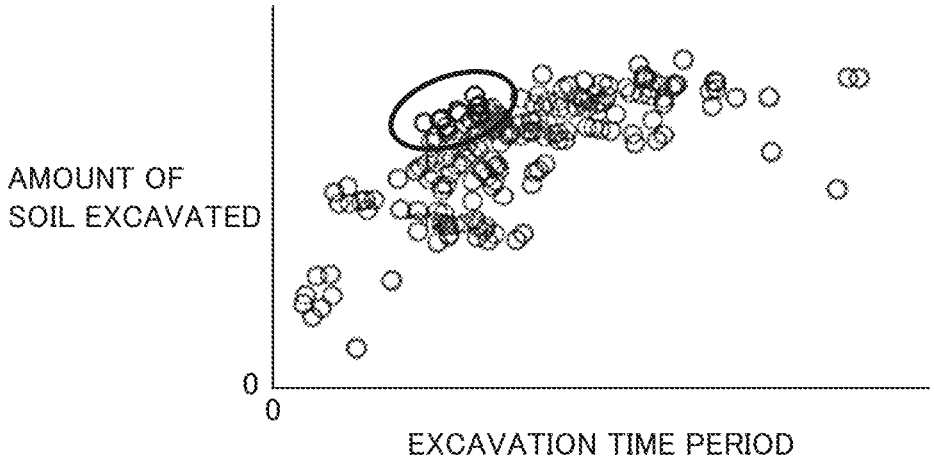
FIG. 4 is a schematic diagram showing productivity of the excavation work.

FIG. 4 is a schematic diagram showing productivity of the excavation work by wheel loader 1. The horizontal axis of the graph shown in FIG. 4 represents a required time period from the start to the end of the excavation work (which will be hereinafter referred to as an excavation time period). The time at which the excavation work is started is set at time 0. The vertical axis in FIG. 4 represents the amount of the excavation target scooped into bucket 6 (which will be hereinafter referred to as an amount of soil excavated) through the excavation work. The excavation time period and the amount of soil excavated that are measured during actual execution of the excavation work are plotted in the graph shown in FIG. 4. Excavation works performed by a plurality of operators, desirably several tens of thousands or more of excavation works, are plotted in FIG. 4.

The productivity of the excavation work is determined based on the excavation time period and the amount of soil excavated. When two excavation works performed in the same excavation time period are compared, the excavation work providing a larger amount of soil excavated is determined as achieving higher productivity. When two excavation works providing the same amount of soil excavated are compared, the excavation work performed in a shorter excavation time period is determined as achieving higher productivity. It is recognized that the excavation time period and the fuel consumption strongly correlate with each other, and the horizontal axis in FIG. 4 represents fuel consumption. The excavation work consuming less fuel and providing a larger amount of soil excavated is determined as excavation achieving higher productivity. Several excavation works are extracted from a plurality of excavation works based on the level of productivity. For example, the excavation works surrounded by an ellipse in FIG. 4 and each consuming relatively less fuel and providing a relatively larger amount of soil excavated is determined as an excavation work achieving higher productivity, and thus extracted.

Based on the data of the extracted excavation works, model data is generated as a model used when the operator manipulates manipulation device 8 for an excavation work. Model data can be generated by taking a weighted average of data of the plurality of the extracted excavation works. Controller 10 generates model data from the accelerator opening degree, boom angle θ1, and bell crank angle θ2 that are obtained during the extracted excavation works. The generated model data is stored in memory 10M. Memory 10M corresponds to a storage unit in the embodiment that stores model data.

Memory 10M stores model data serving as a model when accelerator manipulation member 81*a* is manipulated. Memory 10M stores model data serving as a model when boom manipulation member 83*a* is manipulated. Memory 10M stores model data serving as a model when bucket manipulation member 84*a* is manipulated. Memory 10M stores model data serving as a model when a plurality of types of manipulation members are manipulated, for each type of manipulation member.

Figure 5:
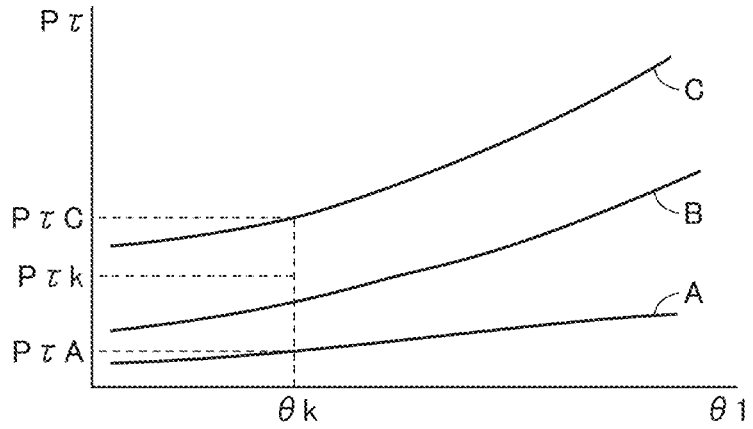
FIG. 5 is a graph showing an example of a relation between a boom angle and a boom pressure for each amount of soil excavated.

An example of a method of calculating the amount of soil excavated will be hereinafter described. FIG. 5 is a graph showing an example of the relation between boom angle θ1 and a boom pressure Pt for each amount of soil excavated. In the graph in FIG. 5, the horizontal axis represents boom angle θ1 while the vertical axis represents boom pressure Pt. Boom pressure Pt refers to the pressure of hydraulic oil in an oil chamber of boom cylinder 16 that is detected by first hydraulic pressure detector 95. In FIG. 5, a curve A shows the case where bucket 6 is empty, a curve B shows the case where bucket 6 is half full, and a curve C shows the case where bucket 6 is full. Based on the graph showing the relation between boom angle θ1 and boom pressure Pt with respect to two or more amounts of soil excavated that are measured in advance, a graph showing the relation between the amount of soil excavated and boom pressure Pt for each boom angle θ1 can be obtained as shown in FIG. 5.

Figure 6:
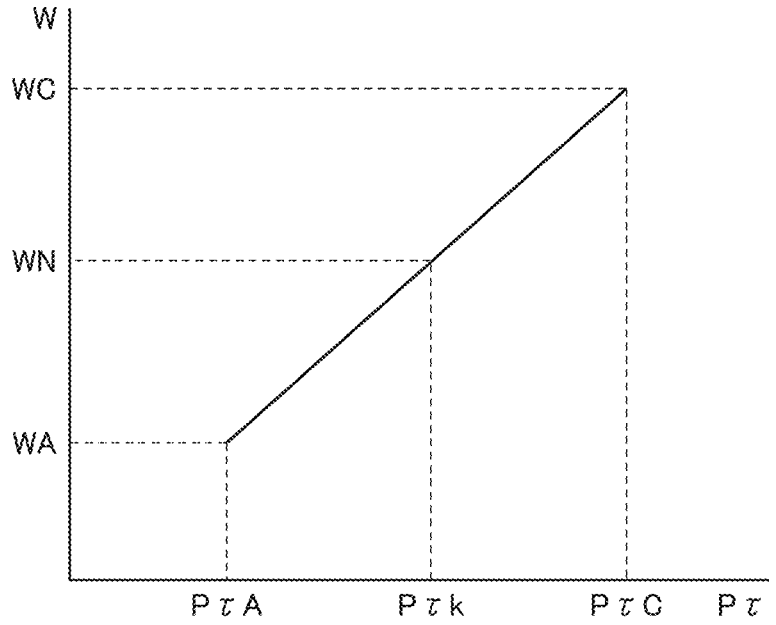
FIG. 6 is a graph showing a relation between the boom pressure and the amount of soil excavated, at a boom angle.

When boom angle θ1 and boom pressure Pt at a certain time point are obtained, the amount of soil excavated at that time point can be calculated. For example, assuming that boom angle θ1=θk and boom pressure Pτ=Pτk at a certain time point mk as shown in FIG. 5, an amount of soil excavated WN at that time point mk can be calculated from FIG. 6. FIG. 6 is a graph showing the relation between boom pressure Pτ and a load weight W at boom angle θ1=θk. In the graph in FIG. 6, the horizontal axis represents boom pressure Pτ while the vertical axis represents amount of soil excavated W.

As shown in FIG. 5, PTA represents boom pressure occurring when bucket 6 is empty at boom angle θ1=θk. PτC represents boom pressure occurring when bucket 6 is full at boom angle θ1=θk. WA shown in FIG. 6 represents a load weight occurring when bucket 6 is empty at boom angle θ1=θk. Further, WC represents a load weight occurring when bucket 6 is full at boom angle θ1=θk.

When Pτk is located between PTA and PτC as shown in FIG. 5, amount of soil excavated WN at time point mk can be determined by performing linear interpolation. Alternatively, amount of soil excavated WN can also be obtained based on the numerical table in which the above-described relation is stored in advance.

The method of calculating the amount of soil excavated in bucket 6 is not limited to the examples shown in FIGS. 5 and 6. In addition to or in place of the boom pressure and boom angle θ1, the pressure difference between the head pressure and the bottom pressure of bucket cylinder 19, the bucket angle, the dimensions of work implement 3, and the like can be taken into consideration as parameters for calculating the amount of soil excavated in bucket 6. By calculation in consideration of these parameters, the amount of soil excavated can be more accurately calculated.

<Display Screen>

Figure 7:
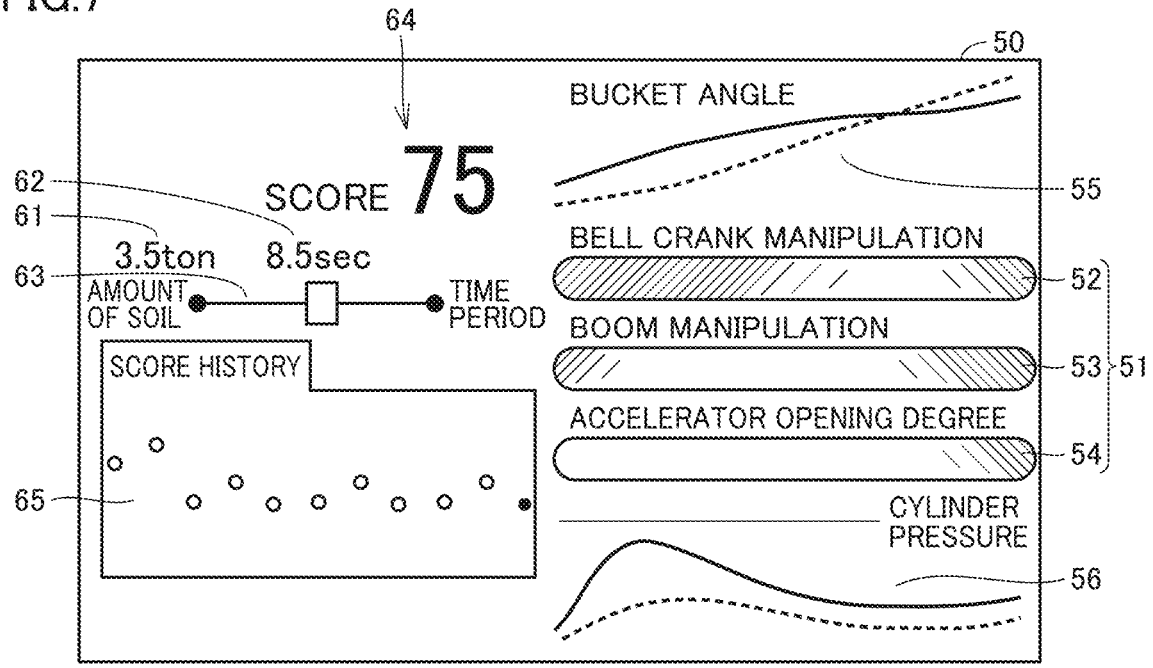
FIG. 7 is a diagram showing an example of a display screen displayed on a display unit.

FIG. 7 is a diagram showing an example of a display screen displayed on display unit 50. As shown in FIG. 7, display unit 50 displays, by way of example, difference data 51, a bucket angle comparison unit 55, a cylinder pressure comparison unit 56, an amount of soil excavated 61, an excavation time period 62, a selection unit 63, a score 64, and a score history 65. The display screen displayed on display unit 50 is updated when one excavation work ends.

When blade edge 6*a* of bucket 6 digs into the excavation target, the pressure of the hydraulic oil in the oil chamber of boom cylinder 16 rises. For example, by detecting that the pressure of the hydraulic oil in the oil chamber of boom cylinder 16 has risen during forward traveling of wheel loader 1, it can be determined that the excavation work has started. For example, by detecting that the direction of traveling of wheel loader 1 that travels forward during the excavation work is switched to rearward traveling, it can be determined that the excavation work has ended.

Difference data 51 includes bell crank manipulation difference data 52, boom manipulation difference data 53, and accelerator opening degree difference data 54.

Bell crank manipulation difference data 52 represents a result of comparison between bell crank angle θ2 of the model data and bell crank angle θ2 formed by bell crank 18 operated in accordance with the actual manipulation of bucket manipulation member 84*a* by the operator. More specifically, bell crank manipulation difference data 52 represents a difference between bell crank angle θ2 of the model data and bell crank angle θ2 of the actual manipulation data obtained in accordance with the actual manipulation by the operator.

Bell crank manipulation difference data 52 represents a change over time in a result of comparison between bell crank angle θ2 of the actual manipulation data and bell crank angle θ2 of the model data in a time period during an excavation work, specifically, in a time period from the start to the end of the excavation work. Display unit 50 displays the comparison between bell crank angle θ2 of the actual manipulation data and bell crank angle θ2 of the model data in a time-series manner.

Boom manipulation difference data 53 represents a result of comparison between boom angle θ1 of the model data and boom angle θ1 formed by boom 14 operated in accordance with the actual manipulation of boom manipulation member 83*a* by the operator. More specifically, boom manipulation difference data 53 represents a difference between boom angle θ1 of the model data and boom angle θ1 of the actual manipulation data obtained in accordance with the actual manipulation by the operator.

Boom manipulation difference data 53 represents a change over time in the result of comparison between boom angle θ1 of the actual manipulation data and boom angle θ1 of the model data in a time period during the excavation work, specifically, in a time period from the start to the end of the excavation work. Display unit 50 displays the comparison between boom angle θ1 of the actual manipulation data and boom angle θ1 of the model data in a time-series manner.

Accelerator opening degree difference data 54 represents a result of comparison between the accelerator opening degree of the model data and the accelerator opening degree detected by accelerator manipulation detection unit 81*b* in accordance with actual manipulation of accelerator manipulation member 81*a* by the operator. More specifically, accelerator opening degree difference data 54 represents the difference between the accelerator opening degree of the model data and the accelerator opening degree of the actual manipulation data obtained in accordance with the actual manipulation by the operator.

Accelerator opening degree difference data 54 represents a change over time in the result of comparison between the accelerator opening degree of the actual manipulation data and the accelerator opening degree of the model data in a time period during the excavation work, specifically, in a time period from the start to the end of the excavation work. Display unit 50 displays the comparison between the accelerator opening degree of the actual manipulation data and the accelerator opening degree of the model data in a time-series manner.

Bucket angle comparison unit 55 displays the superimposed state of bell crank angle θ2 of the actual manipulation data and bell crank angle θ2 of the model data in a time period during the excavation work, specifically, in a time period from the start to the end of the excavation work. The solid line in the figure indicates bell crank angle θ2 of the actual manipulation data, and the broken line in the figure indicates bell crank angle θ2 of the model data. Bucket angle comparison unit 55 displays a change over time in bell crank angle θ2 of the actual manipulation data and bell crank angle θ2 of the model data. Display unit 50 displays the comparison between bell crank angle θ2 of the actual manipulation data and bell crank angle θ2 of the model data in a time-series manner.

Cylinder pressure comparison unit 56 displays the superimposed state of boom pressure Pτ of the actual manipulation data and boom pressure Pτ of the model data in a time period during the excavation work, specifically, in a time period from the start to the end of the excavation work. The solid line in the figure represents boom pressure Pτ of the actual manipulation data, and the broken line in the figure represents boom pressure Pτ of the model data. Cylinder pressure comparison unit 56 displays a change over time in boom pressure Pτ of the actual manipulation data and boom pressure Pτ of the model data. Display unit 50 displays the comparison between boom pressure Pτ of the actual manipulation data and boom pressure Pτ of the model data in a time-series manner.

In difference data 51, bucket angle comparison unit 55, and cylinder pressure comparison unit 56, the left-right direction in the figure represents the passage of time. The left end of the display corresponds to the time point at which excavation starts, and the right end of the display corresponds to the time point at which excavation ends. Each actual manipulation data is not displayed as it is on display unit 50, but is displayed on display unit 50 in the state where each actual manipulation data is adjusted in terms of the time axis such that the time periods displayed on display unit 50 start at the same start time point and end at the same end time point.

Figure 8:
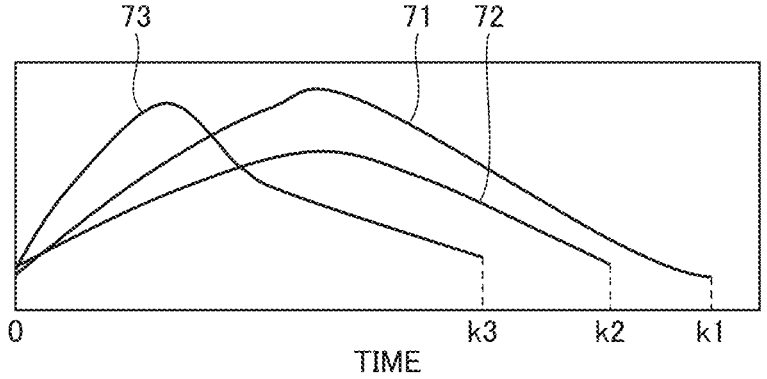
FIG. 8 is a schematic diagram showing actual manipulation data before time axis adjustment.

FIG. 8 is a schematic diagram showing the actual manipulation data before time axis adjustment. The horizontal axis in FIG. 8 indicates time. The time point at which the excavation work starts is defined as time 0. Acquired data 71 shown in FIG. 8 represents raw data of the actual manipulation data acquired when the excavation work is performed until the excavation work ends (=k1), i.e., when the excavation work is performed in an excavation time period k1. Similarly, acquired data 72 represents raw data of the actual manipulation data acquired when the excavation work is performed in an excavation time period k2. Acquired data 73 represents raw data of the actual manipulation data acquired when the excavation work is performed in an excavation time period k3.

As described above, since the excavation time period is different for each excavation work, the actual manipulation data as being raw data is not compared with the model data, but the raw data needs to be processed to be adjusted in terms of the time axis before the comparison between the actual manipulation data and the model data is displayed on display unit 50.

Figure 9:
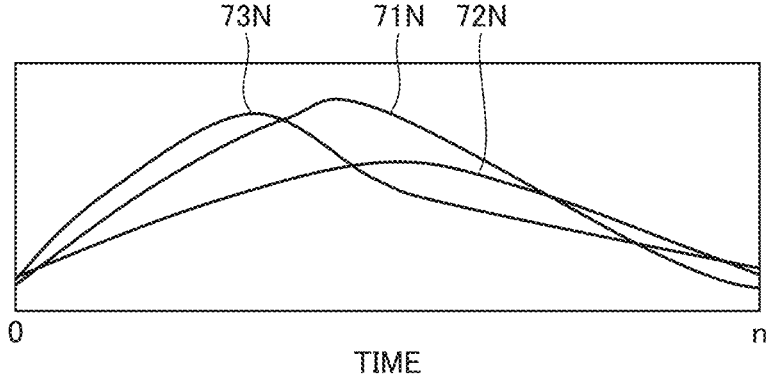
FIG. 9 is a schematic diagram showing actual manipulation data after time axis adjustment.

FIG. 9 is a schematic diagram showing the actual manipulation data after time axis adjustment. The horizontal axis in FIG. 9 indicates time. The time axis is adjusted such that an excavation time period n is set, and acquired data 71 in actual excavation time period k1 is set to be normalized data 71N shown in FIG. 9. Similarly, acquired data 72 and acquired data 73 are also set to be normalized data 72N and normalized data 73N, respectively, in excavation time period n. The model data is also adjusted to be displayed in excavation time period n. In this way, the excavation time periods of their respective excavation works are adjusted in terms of the time axis, so that the actual manipulation data and the model data can be compared with each other.

Further, a plurality of time points at which excavation time period n is equally divided are set and actual manipulation data is obtained at each of the time points, and thereby, comparison with the model data can be facilitated. For example, 98 time points may be set, and actual manipulation data at a total of 100 time points including a time point 0 and a time point n may be obtained. When the raw data of the actual manipulation data does not include a detection result detected at any one of the set time points, the detection result detected at the nearest time point before this any one of the set time points and the detection result detected at the nearest time point after this any one of the set time points are linearly interpolated, and thereby, the actual manipulation data at each of the set time points can be obtained.

Referring back to FIG. 7, hatching shown in difference data 51 and extending from the upper right to the lower left represents that the amount of actual manipulation of manipulation device 8 by the operator that is represented by the actual manipulation data is smaller than the manipulation amount as a model example that is represented by the model data. Further, hatching shown in difference data 51 and extending from the upper left to the lower right represents that the amount of actual manipulation of manipulation device 8 by the operator that is represented by the actual manipulation data is larger than the manipulation amount as a model example that is represented by the model data. Fineness of the hatching represents the extent of the deviation from the model data. The blank area shown in difference data 51 represents that the amount of actual manipulation of manipulation device 8 by the operator that is represented by the actual manipulation data is close to the manipulation amount as a model example that is represented by the model data, and also that the difference between the actual manipulation data and the model data is sufficiently small.

In difference data 51, the difference of the actual manipulation data from the model data can be displayed in a color-coded manner. For example, in difference data 51 shown in FIG. 7, each blank area may be shown in green, each area of hatching extending from the upper right to the lower left may be shown in yellow, and each area of hatching extending from the upper left to the lower right may be shown in red.

In the example shown in FIG. 7, the manipulation amount of bucket manipulation member 84*a* represented by bell crank manipulation difference data 52 is smaller than the manipulation amount of the model data during the time period from the start time point of the excavation work to about the middle of the excavation work. After about the middle of the excavation work, the manipulation amount of bucket manipulation member 84*a* is substantially the same as the manipulation amount of the model data. Near the end of the excavation work, the manipulation amount of bucket manipulation member 84*a* is larger than the manipulation amount of the model data.

At the point of time when the excavation work is started, the manipulation amount of boom manipulation member 83*a* that is represented by boom manipulation difference data 53 is smaller than the manipulation amount of the model data. After a short time period has elapsed since the start of the excavation work, the manipulation amount of boom manipulation member 83*a* is substantially the same as the manipulation amount of the model data. Near the end of the excavation work, the manipulation amount of boom manipulation member 83*a* is larger than the manipulation amount of the model data.

In the time period from the start of the excavation work to the last half of the excavation work, the manipulation amount of accelerator manipulation member 81*a* that is represented by accelerator opening degree difference data 54 is substantially the same as the manipulation amount of the model data. Near the end of the excavation work, the accelerator opening degree is larger than that of the model data.

Memory 10M stores changes over time in model data with respect to the manipulations of accelerator manipulation member 81*a*, boom manipulation member 83*a*, and bucket manipulation member 84*a*. Controller 10 adjusts the time axes of the model data and the actual manipulation data that each change over time, and then, compares the model data and the actual manipulation data at each time point to thereby obtain a difference between the model data and the actual manipulation data at each time point. Display unit 50 displays the difference in a color-coded manner. Difference data 51 displayed on display unit 50 is an example of the display data related to the model data.

Amount of soil excavated 61 represents the amount of the excavation target scooped into bucket 6 in the excavation work, which is obtained when the display screen is updated. Excavation time period 62 represents the time period required from the start to the end of excavation in the excavation work, which is obtained when the display screen is updated.

Selection unit 63 is displayed in the shape of a selection bar by way of example. The operator can manipulate selection unit 63, for example, move a selector to the left or right on a bar extending in the left-right direction in FIG. 7 to change the position of the selector, and thereby, can select which of the amount of soil excavated and the excavation time period is prioritized. In the example shown in FIG. 7, the selector is moved in the left direction to come closer to the indication of "amount of soil", so that the amount of soil excavated is selected to be prioritized. The selector is moved in the right direction to come closer to the indication of "time period", so that the excavation time period is selected to be prioritized. Depending on the degree to which the selector is moved in the left-right direction, it becomes possible to adjust selection as to what degree the amount of soil excavated or the excavation time period is prioritized.

The excavation work to be extracted varies according to the operator's selection when model data is generated. When the amount of soil excavated is selected to be prioritized, the excavation work providing a larger amount of soil excavated is extracted even if the excavation work is performed in a longer excavation time period. When the excavation time period is selected to be prioritized, the excavation work performed in a shorter excavation time period is extracted even if the excavation work provide a smaller amount of soil excavated.

Score 64 is calculated based on amount of soil excavated 61 and excavation time period 62. As amount of soil excavated 61 is larger and excavation time period 62 is shorter, the value represented as score 64 becomes larger. The productivity of the excavation work is evaluated based on score 64. By referring to score 64, the operator can recognize the level of the productivity of the currently performed excavation work.

Score history 65 represents a history of scores 64 obtained in a plurality of excavation works. Based on score history 65, the history of the productivity in a plurality of excavation works is evaluated. By referring to score history 65, the operator can recognize the level of the productivity of the series of excavation works.

<Functions and Effects>

The following describes the functions and effects of the above-described embodiment.

The manipulation guide device according to the embodiment includes display unit 50 shown in FIG. 7. Display unit 50 displays a change over time in the result of comparison between the actual manipulation data about an actual manipulation of manipulation device 8 by the operator and the model data serving as a model when the operator manipulates manipulation device 8, in a time period during the operation of wheel loader 1.

By looking at the display on display unit 50, the operator can recognize the comparison between the actual manipulation data representing the manipulation actually performed when an excavating work is performed and the model data representing a model manipulation for the excavating work. The operator can easily recognize how the actual manipulation by the operator differs from the model manipulation. By recognizing the difference from the model data, the operator can perform a manipulation closer to that of the model data in the next excavation work, and thereby, the operator can improve his/her own work.

As shown in FIG. 7, display unit 50 displays a difference between the model data and the actual manipulation data. By looking at the difference displayed on display unit 50, the operator can easily recognize whether the actual manipulation amount is larger or smaller than the amount of the model manipulation. By recognizing the difference from the model data, the operator can perform the manipulation closer to that of the model data in the next excavation work, and thereby, the operator can improve his/her own work.

As shown in FIG. 7, display unit 50 displays the difference between the model data and the actual manipulation data in a color-coded manner. The operator can more easily recognize the difference by looking at the color-coded data displayed on display unit 50.

As shown in FIG. 2, manipulation device 8 includes accelerator manipulation member 81*a* manipulated to cause wheel loader 1 to travel. The model data and the actual manipulation data each include the amount of manipulation of accelerator manipulation member 81*a*. By looking at the display on display unit 50, the operator can easily recognize how the manipulation of accelerator manipulation member 81*a* for causing wheel loader 1 to travel is different from the model manipulation.

As shown in FIG. 1, wheel loader 1 includes work implement 3 including boom 14 and bucket 6. As shown in FIG. 2, manipulation device 8 includes boom manipulation member 83*a* manipulated to operate boom 14 and bucket manipulation member 84*a* manipulated to operate bucket 6. The model data and the actual manipulation data each include the amount of manipulation of boom manipulation member 83*a* and the amount of manipulation of bucket manipulation member 84*a*. By looking at the display on display unit 50, the operator can easily recognize how the manipulations of boom manipulation member 83*a* and bucket manipulation member 84*a* for operating boom 14 and bucket 6, respectively, are different from their respective model manipulations.

As shown in FIG. 4, the productivity of the excavation work is determined based on the excavation time period and the amount of soil excavated. The model data is generated by extracting an excavation work from a plurality of excavation works based on the level of productivity. From the plurality of excavation works, an excavation work performed in a shorter excavation time period and providing a larger amount of soil excavated and therefore achieving higher productivity is extracted and used as model data. Thus, as the operator tries to bring his/her own manipulation closer to that of the model data for improvement, the productivity of the excavation work can be improved.

As shown in FIG. 7, display unit 50 further includes selection unit 63. By manipulating selection unit 63, the operator can select which of the excavation time period and the amount of soil excavated is prioritized. When model data is generated, the excavation work to be extracted varies according to operator's selection. The operator selects the level of priority between shortening of the excavation time period and increase of the amount of soil excavated, and then, the excavation work corresponding to the selection is extracted to generate model data. Thereby, the model data corresponding to the operator's selection can be generated.

As shown in FIG. 7, display unit 50 displays a change over time in the result of comparison between the actual manipulation data and the model data in a time period from the start to the end of the excavation work. Thereby, the operator can recognize the comparison between the actual manipulation data and the model data over the entire time period of the excavation work. The operator can improve the manipulation of manipulation device 8 during the entire time period from the start to the end of the excavation work in the next excavation work.

As shown in FIGS. 7 to 9, the model data and the actual manipulation data are adjusted in terms of the time axis such that the time periods displayed on display unit 50 start at the same start time point and end at the same end time point. Even when the excavation time period in which the actual manipulation data is acquired is different from that of the model data, but when the actual manipulation data and the model data are adjusted in terms of the time axis, the actual manipulation data and the model data can be more accurately compared with each other.

The manipulation system according to the embodiment is a manipulation system for wheel loader 1, and includes: a plurality of types of manipulation members manipulated by an operator to operate wheel loader 1; and a storage unit, as shown in FIG. 2. The storage unit stores model data used as a model when the manipulation member is manipulated, for each type of the manipulation members.

By using the model data for each type of the manipulation members, the manipulation amount by which the operator actually manipulates the manipulation member can be compared with that of the model data for each manipulation member. Based on the comparison result, the operator can easily recognize how the actual manipulation is different from the model manipulation for each manipulation member. Recognizing the difference from the model data allows the operator to bring the amount of manipulation of the manipulation member closer to that of the model data in the next excavation work. Therefore, the manipulation system according to the embodiment can be suitably used for instructing the operator to manipulate the manipulation member.

Since the storage unit stores the change over time in model data in a time period during the operation of wheel loader 1, for example, in a time period from the start to the end of the excavation work, the operator can easily recognize, for each manipulation member, at which point during the work and how the actual manipulation differs from the model manipulation.

As shown in FIG. 7, the manipulation system further includes display unit 50 that displays display data related to the model data. Thereby, by looking at the display on display unit 50, the operator can easily recognize, for each manipulation member, how the actual manipulation is different from the model manipulation.

As shown in FIG. 2, the manipulation member includes accelerator manipulation member 81*a* manipulated to cause wheel loader 1 to travel. The operator can easily recognize how the actual manipulation of accelerator manipulation member 81*a* for causing wheel loader 1 to travel is different from the model manipulation.

As shown in FIG. 1, wheel loader 1 includes work implement 3 including boom 14 and bucket 6. As shown in FIG. 2, the manipulation member includes boom manipulation member 83*a* manipulated to operate boom 14 and bucket manipulation member 84*a* manipulated to operate bucket 6. The operator can easily recognize how the actual manipulations of boom manipulation member 83*a* and bucket manipulation member 84*a* for operating boom 14 and bucket 6, respectively, are different from their respective model manipulations.

The above embodiment has described an example in which memory 10M stores model data used when an excavation work for scooping an excavation target into bucket 6 is performed, and the actual manipulation data and the model data in a certain time period during the excavation work are compared with each other. The concept of the above-described embodiment is not limited to the case where the work machine performs an excavation work but is applicable also to the case where the work machine performs other operations such as traveling. The result of comparison between the actual manipulation data and the model data displayed on display unit 50 is not limited to the above-described difference data 51, but may show the superimposed state of the actual operation and the model operation of the three-dimensionally modeled work machine, for example.

The above embodiment has described an example in which wheel loader 1 includes controller 10, and display unit 50 mounted on wheel loader 1 displays the comparison between the actual manipulation data and the model data. Controller 10 and display unit 50 are not necessarily mounted on wheel loader 1. An external controller provided separately from controller 10 mounted on wheel loader 1 and an external display may constitute a system for displaying the comparison between the actual manipulation data and the model data. The external controller and the external display may be located at a worksite of wheel loader 1 or may be located at a remote location distant from the worksite of wheel loader 1.

The above embodiment has described an example in which wheel loader 1 includes cab 5 and is a manned vehicle in which an operator is seated inside cab 5. Wheel loader 1 may be an unmanned vehicle. Wheel loader 1 may not include a cab in which an operator is seated to manipulate wheel loader 1. Wheel loader 1 may not have a steering function executed by an operator who is seated therein. Wheel loader 1 may be a work machine exclusively for remote control. Wheel loader 1 may be controlled by a wireless signal from a remote control device.

It should be understood that the embodiments disclosed herein are illustrative and non-restrictive in every respect. The scope of the present invention is defined by the terms of the claims, rather than the description above, and is intended to include any modifications within the meaning and scope equivalent to the terms of the claims.

REFERENCE SIGNS LIST

1 wheel loader, 2 vehicular body frame, 3 work implement, 4 traveling unit, 5 cab, 6 bucket, 6*a* blade edge, 6*b* back surface, 8 manipulation device, 10 controller, 10M memory, 10T timer, 11 steering cylinder, 12 steering pump, 13 work implement pump, 14 boom, 16 boom cylinder, 18 bell crank, 19 bucket cylinder, 21 engine, 29 first angle detector, 34 work implement control valve, 35 steering control valve, 48 second angle detector, 50 display unit, 51 difference data, 52 bell crank manipulation difference data, 53 boom manipulation difference data, 54 accelerator opening degree difference data, 55 bucket angle comparison unit, 56 cylinder pressure comparison unit, 61 amount of soil excavated, 62 excavation time period, 63 selection unit, 64 score, 65 score history, 81*a* accelerator manipulation member, 83*a* boom manipulation member, 84*a* bucket manipulation member, 95 first hydraulic pressure detector, 96 second hydraulic pressure detector, 100 excavation target.

The invention claimed is:

1. A manipulation guide device for a work machine to perform an excavation work for an excavation target, the manipulation guide device comprising:

a manipulation device that is manipulated by an operator of the work machine to operate the work machine;

a memory device that stores model data serving as a model when the manipulation device is manipulated; and a display device that displays a change over time in a result of comparison between actual manipulation data about an actual manipulation of the manipulation device by the operator and the model data in a time period during an operation of the work machine, wherein the display device displays a selectable item that is capable of selecting which of a required time period for the excavation work and an amount of the excavation target is prioritized by the operator.

2. The manipulation guide device according to claim 1, wherein the display device displays a difference between the model data and the actual manipulation data.

3. The manipulation guide device according to claim 2, wherein the display device displays the difference in a color-coded manner.

4. The manipulation guide device according to claim 1, wherein the manipulation device includes a traveling-motion manipulation member manipulated to cause the work machine to travel, and the model data and the actual manipulation data each include a manipulation amount of the traveling-motion manipulation member.

5. The manipulation guide device according to claim 1, wherein the work machine includes a work implement including a boom and a bucket, the manipulation device includes a boom manipulation member manipulated to operate the boom, and a bucket manipulation member manipulated to operate the bucket, and the model data and the actual manipulation data each include a manipulation amount of the boom manipulation member and a manipulation amount of the bucket manipulation member.

6. The manipulation guide device according to claim 5, wherein productivity of an excavation work is determined by: a required time period for the excavation work for scooping an excavation target into the bucket; and an amount of the excavation target scooped in the bucket, and the model data is generated by extracting an excavation work from a plurality of the excavation works based on a level of the productivity.

7. The manipulation guide device according to claim 1, wherein the excavation work to be extracted varies according to selection by the operator.

8. The manipulation guide device according to claim 5, wherein the time period extends from a start to an end of an excavation work for scooping an excavation target into the bucket.

9. The manipulation guide device according to claim 1, wherein the model data and the actual manipulation data are adjusted in terms of a time axis such that a plurality of the time periods displayed on the display device start at a same start time point and end at a same end time point.

10. A manipulation guide device for a work machine to perform an excavation work for scooping an excavation target, the manipulation guide device comprising:

a manipulation device that is manipulated by an operator of the work machine to operate the work machine;

a memory device that stores model data serving as a model when the manipulation device is manipulated; and a display device that displays a change over time in a result of comparison between actual manipulation data about an actual manipulation of the manipulation device by the operator and the model data in a time period during an operation of the work machine, wherein the display device displays together a required time period from a start to an end of the excavation work, an amount of the excavation target scooped by the excavation work, a score indicating a productivity of the excavation work calculated based on at least one of the required time period and the amount of the excavation target, and a history of scores in a plurality of the excavation works.

11. The manipulation guide device according to claim 10, wherein the display device displays a selectable item configured to prioritize one of the required time period and the amount of the excavation target.

* * * * *